United States Patent [19]

Kondo et al.

[11] 4,358,521

[45] Nov. 9, 1982

[54] PHOTOCONDUCTIVE COMPOSITION WITH 5-NITROFURFURAL DERIVATIVE SENSITIZER

[75] Inventors: Syunichi Kondo; Hirotsugu Nomaguchi; Hideo Sato, all of Asaka, Japan

[73] Assignee: Fuji Photo Film Co., Ltd., Kanagawa, Japan

[21] Appl. No.: 261,862

[22] Filed: May 8, 1981

[30] Foreign Application Priority Data

May 8, 1980 [JP] Japan ..... 55-61157

[51] Int. Cl.[3] ..... G03G 5/09

[52] U.S. Cl. ..... 430/83; 430/81; 430/37

[58] Field of Search ..... 430/37, 81, 83, 75, 430/76, 77, 78

[56] References Cited

U.S. PATENT DOCUMENTS

| | | | |
|---|---|---|---|
| 3,140,946 | 7/1964 | Cassiers et al. | 430/75 X |
| 3,174,854 | 3/1965 | Stumpf et al. | 430/76 |
| 3,507,648 | 4/1970 | Ford et al. | 430/83 |

*Primary Examiner*—Roland E. Martin, Jr.
*Attorney, Agent, or Firm*—Sughrue, Mion, Zinn, Macpeak & Seas

[57] ABSTRACT

Photoconductive compositions and electrophotographic photoreceptive materials are described containing a photo-conductive substance and a 5-nitrofurfural derivative represented by formula (1)

(1)

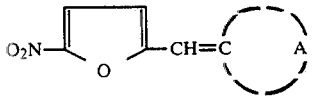

wherein A represents atoms which form, together with the carbon atom, a moiety represented by one of formulae (2) to (10)

(2)

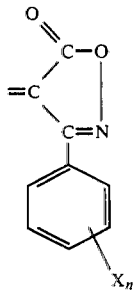

-continued (3)

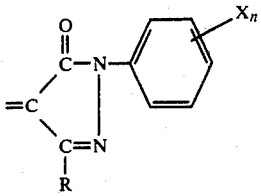

(4)

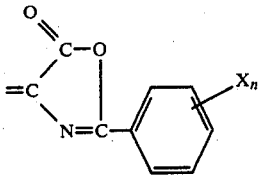

(5)

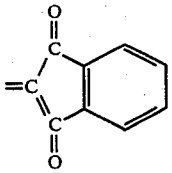

(6)

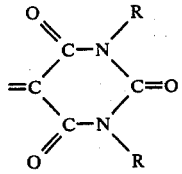

(7)

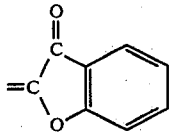

(8)

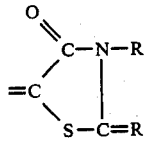

(9)

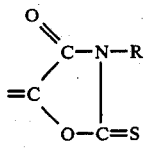

(10)

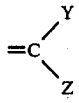

wherein R represents a straight or branched chain alkyl group containing from 1 to 12 carbon atoms, X represents a group having a Hammett $\sigma$ value of at least 0.2, n is 0, 1 or 2, and Y and Z each represents a cyano group, —COOR,

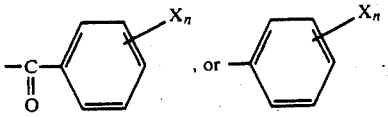

6 Claims, No Drawings

PHOTOCONDUCTIVE COMPOSITION WITH 5-NITROFURFURAL DERIVATIVE SENSITIZER

FIELD OF THE INVENTION

This invention relates to a photoconductive composition and to a highly receptive electrophotographic photoreceptive material utilizing such a photoconductive composition.

BACKGROUND OF THE INVENTION

Investigations into organic photo-semiconductors have been made with a view to utilizing them in electrophotography. The photoconductivity of polyvinylcarbazole and the use of polyvinylcarbazole in electrophotography are known, e.g., as described in German Patent Publication No. 1,068,115 and U.S. Pat. No. 3,037,861. The above-described published patent specification also describes that the photosensitivity of polyvinylcarbazole can be enhanced by addition of a small amount of dye.

Electrophotographic recording materials having photoconductive films formed from photoconductive compositions containing 0.49 to 1.23 mole of 2,4,7-trinitro-9-fluorenone per mole of constitutional repeating unit of a polymerized heterocyclic vinyl compound, such as polyvinylcarbazole, are known, e.g., as described in German Patent Publication No. 1,572,347 and U.S. Pat. No. 3,484,237. In addition, the electrophotographic recording material described in German Patent Application (OLS) No. 1,797,561 includes a photoconductive film formed from a photoconductive composition containing equiparts (by weight) of 2,4,7-trinitro-9-fluorenone and polyvinylcarbazole. R. M. Schaffert reports in *IBM Journal of Research and Development,* Volume 15, No. 1, pages 75–89 (1971) that the above-described recording materials possess excellent various properties which are attributable to the charge transfer complexes constituting their respective photoconductive films. Furthermore, R. M. Schaffert, supra, at page 76 describes that many substances reported to be able to act as a sensitizer for polyvinylcarbazole have poor compatibility with polyvinylcarbazole, and they often affect adversely the photosensitivity of polyvinylcarbazole when used in high concentrations. Furthermore, R. M. Schaffert, supra, at page 77 describes that none of these many substances is as useful as 2,4,7-trinitro-9-fluorenone, and that substances possessing effectiveness equal to or greater than that of 2,4,7-trinitro-9-fluorenone have never been found. However, the trinitrofluorenone is expensive and has extremely high physiological activity. Therefore, it has been an important subject in this art to discover compounds having sensitizing abilities equal to that of the trinitrofluorenone without having the disadvantages of the trinitrofluorenone.

SUMMARY OF THE INVENTION

Thus, an object of this invention is to find compounds that possess photosensitivities at least equal to that of the polyvinylcarbazole-trinitrofluorenone composition, and that are more economical than said composition. Particularly, an object of this invention is to find compounds capable of sensitizing polyvinylcarbazole to a great extent.

The above-described object is attained with photoconductive compositions comprising of photoconductive substances and 5-nitrofurfural derivatives represented by formula (1):

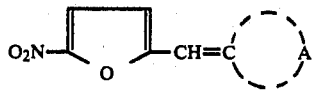

(1)

wherein A represents atoms which form, together with the carbon atom, a moiety represented by one of formulae (2) to (10)

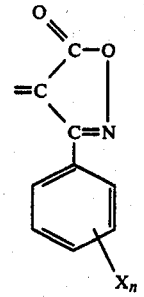

(2)

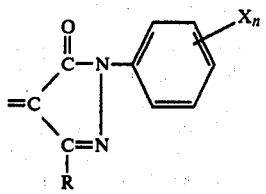

(3)

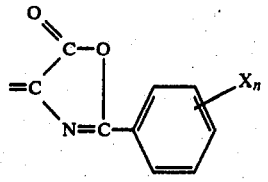

(4)

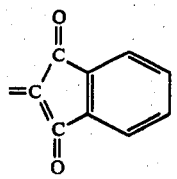

(5)

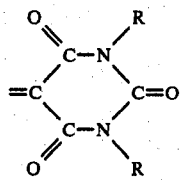

(6)

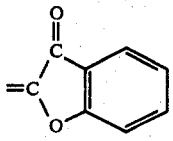

(7)

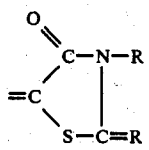

(8)

-continued

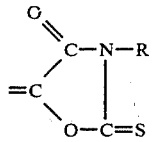

(9)

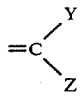

(10)

wherein R represents a straight or a branched chain alkyl group containing from 1 to 12 carbon atoms, X represents a group having a Hammett $\sigma$ value of at least 0.2, n is 0, 1 or 2, and Y and Z each represents a cyano group, —COOR,

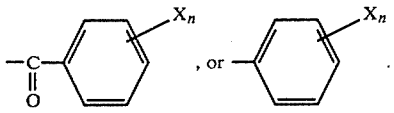

DETAILED DESCRIPTION OF THE INVENTION

As used herein, the expression "Hammett $\sigma$ value" is defined according to the definition provided by J. E. Leffler, *Theory of Organic Reaction Process* (Yuho Tsuno (Translator), *Yuki Hanno Sokudoron,* published by Hirokawa Shoten, Tokyo (1968)).

Specific examples of substituent groups having Hammett $\sigma$ values of at least 0.2 include the cyano group, acetyl group, methoxycarbonyl group, ethoxycarbonyl group, carboxyl group, nitro group, —$PO_3H$ group, mercapto group, methoxythiocarbonyl group, methylsulfinyl group, methylsulfonyl group, sulfamoyl group, fluorine atom, chlorine atom, bromine atom, iodine atom, iodyl group, and 2-nitrovinyl group. Of these groups, more preferable substituents are halogen atoms, nitro group, cyano group and so on.

The atoms represented by the formula (2) is a 3-(substituted or non-substituted)phenyl-5-isooxazolone-4-ylidene group, and its substituted phenyl group, which is situated at the 3-position, can contain as the substituent a group having a Hammett $\sigma$ value of at least 0.2, as described above. Specific examples of the (substituted or non-substituted) phenyl group situated at the 3-position include a phenyl group, p-chlorophenyl group, and p-nitrophenyl group. Thus, in the case wherein the atoms are represented by the formula (2), the compound (1) is a 4-(5'-nitro-2'-furfurylidene)-3-(substituted or non-substituted)phenyl-5-isooxazolone, and a specific example thereof is 4-(5'-nitro-2'-furfurylidene)-3-phenyl-5-isooxazolone.

The atoms represented by the formula (3) is a 3-alkyl-1-(substituted or non-substituted)phenyl-5-pyrazolone-4-ylidene group. Specific examples of the alkyl group situated at the 3-position include methyl group, ethyl group and propyl group, and specific examples of the (substituted or non-substituted) phenyl group situated at its 1-position include phenyl group, p-nitrophenyl group, p-cyanophenyl group and the like. Thus, in the case wherein the atoms are represented by the formula (3), the compound (1) is a 4-(5'-nitro-2'-furfurylidene)-3-alkyl-1-(substituted or non-substituted)phenyl-5-pyrazolone, and specific examples thereof include 4-(5'-nitro-2'-furfurlylidene)-3-methyl-1-phenyl-5-pyrazolone, 4-(5'-nitro-2'-furfurylidene)-3-ethyl-1-phenyl-5-pyrazolone, and 4-(5'-nitro-2'-furfurylidene)-3-propyl-1-phenyl-5-pyrazolone.

The atoms represented by the formula (4) is a 2-(substituted or non-substituted)phenyl-5-oxazolone-4-ylidene group, and specific examples of its substituted or non-substituted phenyl group, which is situated at the 2-position, include phenyl group, p-nitrophenyl group, p-chlorophenyl group, p-bromophenyl group and p-cyanophenyl group. Thus, in the case wherein the atoms are represented by the formula (4), the compound (1) is a 4-(5'-nitro-2'-furfurylidene)-2-(substituted or non-substituted)phenyl-5-oxazolone, and specific examples thereof include 4-(5'-nitro-2'-furfurylidene)-2-phenyl-5-oxazolone, 4-(5'-nitro-2'-furfurylidene)-2-p-chlorophenyl-5-oxazolone, 4-(5'-nitro-2'-furfurylidene)-2-p-bromophenyl-5-oxazolone, 4-(5'-nitro-2'-furfurylidene)-2-p-cyanophenyl-5-oxazolone, and 4-(5'-nitro-2'-furfurylidene)-2-p-nitrophenyl-5-oxazolone.

The atoms represented by the formula (5) is a 1,3-indandione-2-ylidene group, and in this case the compound (1) is 2-(5'-nitro-2'-furfurylidene)-1,3-indandione.

The atoms represented by the formula (6) is a 2,4 5,6-tetrahydro-2,4,6-trioxo-1,3-dialkyl-5-pyrimidinylidene group, and specific examples of the alkyl groups situated at the 1- and the 3-positions include the methyl group, ethyl group, and propyl group. The alkyl substituents at the 1- and 3-positions may be the same or different. Thus, in the case wherein the atoms are represented by the formula (6), the compound (1) is a 5-(5'-nitro-2'-furfurylidene)-1,3-dialkylbarbituric acid, and specific examples thereof include 5-(5'-nitro-2'-furfurylidene)-1,3-dimethylbarbituric acid, 5-(5'-nitro-2'-fufurylidene)-1,3-diethylbarbituric acid, and the like.

The atoms represented by the formula (7) is a 1-benzofuranone-2-ylidene group, and in this case the compound (1) is 2-(5'-nitro-2'-furfurylidene)-1-benzofuranone.

The atoms represented by the formula (8) is a 3-alkylrhodanine-5-ylidene group, and specific examples of the alkyl group situated at the 3-position include methyl group, ethyl group, propyl group, isopropyl group, pentyl group, decyl group and lauryl group. Thus, in the case wherein the atoms are represented by the formula (8), the compound (1) is a 5-(5'-nitro-2'-furfurylidene)-3-alkylrhodanine, and specific examples thereof include 5-(5'-nitro-2'-furfurylidene)-3-methylrhodanine, 5-(5'-nitro-2'-furfurylidene)-3-ethylrhodanine, 5-(5'-nitro-2'-furfurylidene)-3-propylrhodanine, 5-(5'-nitro-2'-furfurylidene)-3-isopropylrhodanine, 5-(5'-nitro-2'-furfurylidene)-3-decylrhodanine, and 5-(5'-nitro-2'-furfurylidene)-3-laurylrhodanine.

The atoms represented by the formula (9) is a 3-alkyl-2-thioxo-4-oxazolidinone-5-ylidene group, and specific examples of the alkyl group situated at the 3-position include a methyl group, ethyl group, propyl group and isopropyl group. Thus, in the case wherein the atoms are represented by the formula (9), the compound (1) is a 5-(5'-nitro-2'-furfurylidene)-3-alkyl-2-thioxo-4-oxazolidinone, and specific examples thereof include 5-(5'-nitro-2'-furfurylidene)-3-methyl-2-thioxo-4-oxazolidinone, 5-(5'-nitro-2'-furfurylidene)-3-ethyl-2-thioxo-4-oxazolidinone, and 5-(5'-nitro-2'-furfurylidene)-3-propyl-2-thioxo-4-oxazolidinone.

The atoms represented by the formula (10) can be a dicyanomethylene group represented by the formula (11), a 1-cyano-1-alkoxycarbonyl methylene group represented by the formula (12), a 1-cyano-1-(substituted or non-substituted)benzoylmethylene group represented by the formula (13), an α-cyano (substituted or non-substituted)benzylidene group represented by the formula (14), a bis(alkoxylcarbonyl)-methylene group represented by the formula (15), a 1-alkoxycarbonyl-1-(substituted or non-substituted)benzoylmethylene group represented by the formula (16), an α-alkoxycarbonyl(-substituted or non-substituted)benzylidene group represented by the formula (17), a bis[(substituted or non-substituted) benzoyl]methylene group represented by the formula (18), and α-(substituted or non-substituted)benzoyl(substituted or non-substituted)benzylidene group represented by the formula (19), or a bis[(substituted or non-substituted benzyl]methylene group represented by the formula (20).

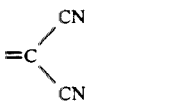
(11)

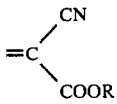
(12)

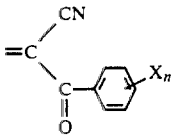
(13)

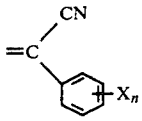
(14)

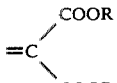
(15)

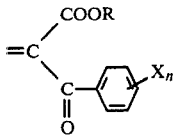
(16)

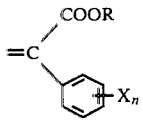
(17)

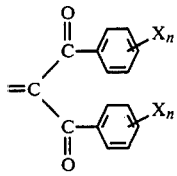
(18)

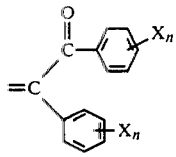
(19)

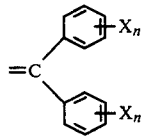
(20)

In the case wherein the atoms represented by the formula (10) is dicyanomethylene group, the compound (1) is (5-nitro-2-furfurylidene)malonitrile.

In the case wherein the atoms represented by the formula (10) is a 1-cyano-1-alkoxycarbonylmethylene group represented by the formula (12), the compound (1) is an alkyl α-cyano-α-(5-nitro-2-furfurylidene)acetate (whose alkyl moiety is, e.g., methyl group, ethyl group, propyl group and isopropyl group), and specific examples thereof include methyl α-cyano-α-(5-nitro-2-furfurylidene)acetate, ethyl α-cyano-α-(5-nitro-2-furfurylidene)acetate, propyl α-cyano-α-(5-nitro-2-furfurylidene)acetate and isopropyl-α-cyano-α-(5-nitro-2-furfurylidene)acetate.

In the case wherein the atoms represented by the formula (10) is a 1-cyano-1-(substituted or non-substituted)-benzoylmethylene group having the formula (13), the compound (1) is an ω-cyano-ω-(5-nitro-2-furfurylidene) (substituted or non-substituted)acetophenone, and specific examples thereof include ω-cyano-ω-(5-nitro-2-furfurylidene)acetophenone, 4', ω-dicyano-ω-(5-nitro-2-furfurylidene)acetophenone (which 4'-position is on its benzene ring) and ω-cyano-ω-(5-nitro-2-furfurylidene)-4'-nitroacetophenone.

In the case wherein the atoms represented by the formula (10) is an α-cyano(substituted or non-substituted)-benzylidene group having the formula (14), the compound (1) is a 2-(5-nitro-2-furfurylidene)-2-(substituted or non-substituted)phenylacetonitrile (specific examples of a substituent which the phenyl group may have include a cyano group and nitro group), and specific examples thereof include 2-(5-nitro-2-furfurylidene)-2-phenylacetonitrile, 2-(5-nitro-2-furfurylidene)-2-p-cyanophenylacetonitrile, and 2-(5-nitro-2-furfurylidene)-2-p-nitrophenylacetonitrile.

In the case wherein the atoms represented by the formula (10) is a bis(alkoxycarbonyl)methylene group having the formula (15), the compound (1) is a dialkyl(5-nitro-2-furfurylidene)malonate (specific examples of the alkyl moieties include a methyl group, ethyl group, and propyl group), and specific examples thereof include dimethyl(5-nitro-2-furfurylidene)malonate and diethyl(5-nitro-2-furfurylidene)malonate.

In the case wherein the atoms represented by the formula (10) is a 1-alkoxycarbonyl-1-(substituted or non-substituted)benzoylmethylene group having the formula (16), the compound (1) is an alkyl α-(5-nitro-2-furfurylidene)-α-(substituted or non-substituted)benzoylacetate (specific examples of the alkyl group include a methyl group, ethyl group, and propyl group), and specific examples thereof include methyl α-(5-nitro-2-furfurylidene)-α-benzoylacetate and the like.

In the case wherein the atoms represented by the formula (10) is an α-alkoxycarbonyl(substituted or non-substituted)benzylidene group having the formula (17), the compound (1) is an alkyl α-(5-nitro-2-furfurylidene)-α-(substituted or non-substituted)phenylacetate (specific examples of the alkyl group include a methyl group, ethyl group, and propyl group, and specific examples of which substituted phenyl moiety include p-cyanophenyl, p-nitrophenyl and p-chlorophenyl), and specific examples thereof include methyl α-(5-nitro-2-furfurylidene)-α-phenylacetate, ethyl α-(5-nitro-2-furfurylidene)-α-phenylacetate, methyl α-(5-nitro-2-furfurylidene)-α-(p-cyanophenyl)-acetate, ethyl α-(5-nitro-2-furfurylidene)-α-(p-cyanophenyl)acetate, methyl α-(5-nitro-2-furfurylidene)-α-(p-nitrophenyl)acetate and ethyl α-(5-nitro-2-furfurylidene)-α-(p-nitrophenyl)acetate.

In the case wherein the atoms represented by the formula (10) is a bis[(substituted or non-substituted)benzoyl]-methylene group having the formula (18), the compound (1) is a 1-(5-nitro-2-furfurylidene)-1-bis[(substituted or non-substituted)benzoyl]methane (specific examples of the substituted benzoyl moiety include p-cyanobenzoyl and p-nitrobenzozyl), and specific examples thereof include 1-(5-nitro-2-furfurylidene)-1-dibenzoylmethane and 1-(5-nitro-2-furfurylidene)-1-bis(p-nitrobenzoyl)methane.

In the case wherein the atoms represented by the formula (10) is an α-(substituted or non-substituted)benzoyl(substituted or non-substituted)benzylidene group having the formula (19), the compound (1) is an ω-(5-nitro-2-furfurylidene)-ω-(substituted or non-substituted)phenyl(substituted or non-substituted-)acetophenone, and specific examples thereof include ω-(5-nitro-2-furfurylidene)-ω-phenylacetophenone and the like.

In the case wherein the atoms represented by the formula (10) is a bis[(substituted or non-substituted)benzyl]-methylene group having the formula (20), the compound (1) is a 1-(5-nitro-2-furfurylidene)-1-bis[(substituted or non-substituted)phenyl]methane, and specific examples thereof include 1-(5-nitro-2-furfurylidene)-1-diphenylmethane and the like.

Each of these compounds can be produced by alkali-catalyzed dehydration condensation of 5-nitrofurfural and an active methylenic compound according to the Knoevenagel condensation process, which is described in *Organic Reactions,* Volume 15, published by John Wiley and Sons, Inc. (1967) pages 204–599. Examples of the alkali employed therein as a catalyst include amines such as diethylamine, triethylamine, piperidine, etc.; ammonia; NaOH; KOH, and $CH_3COONH_4$.

As for the photoconductive polymer, polymers containing $\pi$-electron systems in their main or side chains can be employed. The 5-nitrofurfural derivative represented by the general formula (1) forms a charge transfer complex together with the $\pi$-electron system contained in the photoconductive polymer. As examples of the representatives of $\pi$-electron systems, mention may be made of aromatic hydrocarbons such as naphthalene, anthracene, pyrene, perylene, acenaphthene, phenylanthracene, diphenylanthracene and the like; heterocyclic compounds such as carbazole, indole, acridine, 2-phenylindole, N-phenylcarbazole and the like; halogen or lower alkyl substituted aromatic hydrocarbons; halogen or lower alkyl substituted heterocyclic compounds; and the like. In the present invention, polymers containing these $\pi$-electron systems are employed as the photoconductive polymer. Specific examples of these polymers include vinyl polymers such as polyvinyl naphthalene, polyvinyl anthracene, polyvinyl pyrene, polyvinyl perylene, polyacenaphthylene, polystyrylanthracene, polyvinylcarbazole, polyvinylindole, polyvinyl acridine and the like; vinyl ether polymers such as polyanthrylmethyl vinyl ether, polypyrenylmethyl vinyl ether, polycarbazolylethyl vinyl ether, polyindolylethyl vinyl ether and the like; epoxy resins such as polyglycidylcarbazole, polyglycidylindole, poly-p-glycidylanthrylbenzene and the like; homo- and copolymers of acrylates or methacrylates containing the above-described $\pi$-electron systems as substituents; and condensation polymers of the above-described $\pi$-electron system-containing compounds and formaldehyde. Of the above-described polymers, poly-N-vinylcarbazole and N-vinylcarbazole copolymers are preferred. As N-vinylcarbazole copolymers, those which contain N-ethylenecarbazole as a constitutional repeating unit in fractions of at least 50 mole % can be employed. The repeating unit constituting an N-vinylcarbazole polymer is illustrated below:

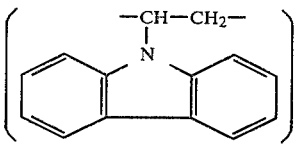

Specific examples of the residual repeating units constituting N-vinylcarbazole copolymers include 1-phenylethylene, 1-cyanoethylene, 1-cyano-1-methylethylene, 1-chloroethylene, 1-(alkoxycarbonyl-)ethylene and 1-alkoxycarbonyl-1-methylethylene (which are the constitutional repeating units derived from styrene, acrylonitrile, methacrylonitrile, vinyl chloride, alkylacrylate and alkylmethacrylate, respectively, and wherein the alkyl moiety of the alkoxycarbonyl group may contain 1 to 18 carbon atoms and specific examples thereof include methyl group, ethyl group, hexyl group, lauryl group, stearyl group and 4-methylcyclohexyl group). The expression "constitutional repeating unit" as used herein corresponds to the definition given in Kōbunshi, Volume 27, pages 345–359 (1978) (which is the Japanese version of *Pure and Applied Chemistry,* Volume 48, pages 373–385 (1976)).

When a 5-nitrofurfural derivative represented by the formula (1) is mixed with a photoconductive polymer, the molar ratio of the former with respect to the constitutional repeating unit containing $\pi$-electron system is preferably from 0.02/1 to 1.5/1, and more preferably from 0.05/1 to 1.2/1. In the case wherein poly-N-vinylcarbazole or an N-vinylcarbazole copolymer is employed as the photoconductive polymer, the constitutional repeating unit which contains a $\pi$-electron system signifies N-ethylenecarbazole.

In addition to the above-described two components, the photoconductive composition of this invention can contain other known sensitizers, binders, plasticizers, dyes, pigments and so on in such amounts that they do not impair the characteristics of the photoconductive composition of this invention.

The photoconductive composition of this invention can be prepared by dissolving the above-described two essential components and other optional components in an appropriate solvent in their respective desired proportions to make a homogeneous solution (a solution of the photoconductive composition) and then, by removing the solvent from the resulting solution (by, e.g., evaporation). For some end-use purposes of the photoconductive composition (e.g., to form a coating solution), a solution of the photoconductive composition can be used as is, and the removal of the solvent therefrom is not required. An electrophotographic photoreceptive material of this invention is constructed using a support having a conductive surface, and a photoconductive layer formed thereon by coating the solution of the photoconductive composition and then drying the resulting coated layer. Such an electrophotographic photoreceptive material may be used in the same manner as heretofore known electrophotographic photoreceptive materials.

For some end-use purposes of the electrophotographic photoreceptive material, an adhesive layer, an overcoat layer and so on may be present. The solvent is selected from those which can dissolve both the photoconductive polymers and the 5-nitrofurfural derivatives having the formula (1) illustrated hereinbefore. Examples of such solvents generally include tetrahydrofuran, dioxane, 1,2-dichloroethane, dichloromethane, monochlorobenzene, cyclohexanone and so on.

As a support having a conductive surface, a metallic drum or sheet (made of aluminium, copper, iron, zinc, or the like), or paper, a plastic film, or a glass plate, at least one side of which is rendered conductive by a metallic vapor deposition technique, the lamination of metallic foil or the coating of a dispersion prepared by dispersing a carbon blank or a metallic powder into a binding polymer, may be employed.

The photoconductive composition of this invention may be granulated and dispersed into an insulating liquid. The resulting dispersion can form an image using an photoelectrophoretic imaging process, as described in U.S. Pat. No. 3,384,565 (corresponding to Japanese Patent Publication 21781/'68), U.S. Pat. No. 3,384,488 (corresponding Japanese Patent Publication 37125/'72), U.S. Pat. No. 3,510,419 (corresponding Japanese Patent Publication 36079/71) and so on.

The photoconductive composition of this invention has photosensitivity to light of wavelengths ranging from the ultraviolet region to the visible region (as far as about 760 nm), apparently due to the formation of a charge transfer complex between the 5-nitrofurfural derivative represented by the formula (1) and the $\pi$-electron system-containing constitutional repeating unit contained in the photoconductive polymer.

This invention will now be illustrated in greater detail by reference to the following examples.

EXAMPLES 1 TO 17

One gram of polyvinylcarbazole (PVCz) and a 5-nitrofurfural derivative (NFD) (used in a molar ratio with respect to the PVCz nuclei of from 0.1/1 to 1.2/1, as indicated in Table 1) were dissolved in 30 g of dichloroethane. The resulting solution was coated on a conductive film (which was constructed of a polyethylene terephthalate film having a thickness of 100 $\mu$m and a surface coating of $I_{n2}O_3$ having a thickness of 60 nm) at a dry thickness of 1.5 $\mu$m. The thus obtained material was dried at 80° C. for 30 minutes, and allowed to stand for one night in the dark. A plus 200 V electric field was applied to the thus processed coat for corona discharging. After one minute, at least 80% of the quantity of electricity gained was retained in each of Examples. In order to examine the sensitivity, the quantity of light required for decreasing the surface potential from 180 V to 90 V (i.e., half decay exposure) was measured for each of Examples. The light source used was a tungsten lamp of 6000 lux, and exposure was carried out through an ND Filter of optical density (O.D.) of 3.

The results obtained are shown in Table 1. Therein, the column headed NFD/PVCz represents the molar ratio of the 5-nitrofurfural derivative to the N-ethylenecarbazole which is the constitutional repeating unit of PVCz.

TABLE 1

| Example | 5-Nitrofurfural Derivative | NFD/PVCz (molar ratio) | Half Decay Exposure (lux.sec) |
|---|---|---|---|
| 1 | 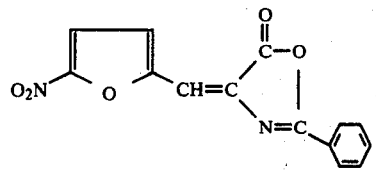 | 0.1 | 55 |
| 2 | The same compound as in Example 1 | 1 | 10 |
| 3 | 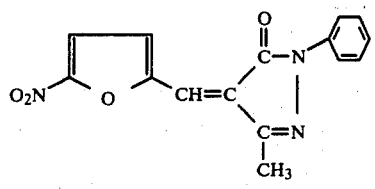 | 0.1 | 380 |
| 4 | 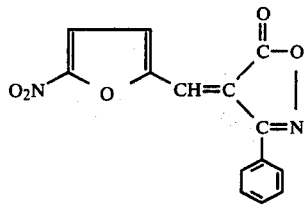 | 0.1 | 85 |
| 5 | 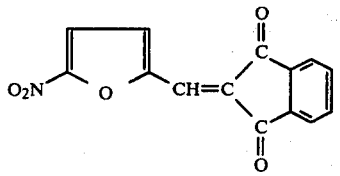 | 0.1 | 106 |
| 6 | 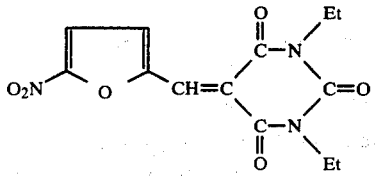 | 0.1 | 125 |

TABLE 1-continued

| Example | 5-Nitrofurfural Derivative | NFD/PVCz (molar ratio) | Half Decay Exposure (lux.sec) |
|---|---|---|---|
| 7 | 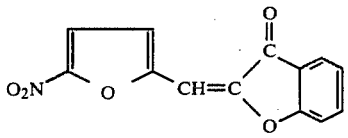 | 0.1 | 50 |
| 8 | 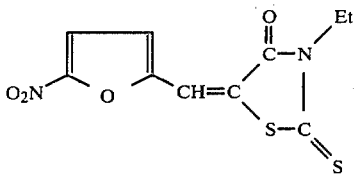 | 0.1 | 45 |
| 9 | The same compound as in Example 8 | 0.2 | 18 |
| 10 | The same compound as in Example 8 | 1 | 9 |
| 11 | 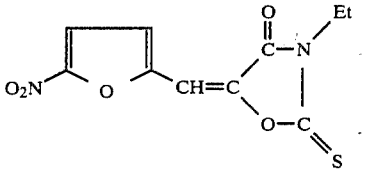 | 0.1 | 47 |
| 12 | 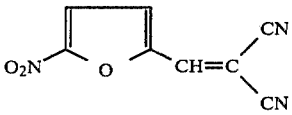 | 0.1 | 305 |
| 13 | 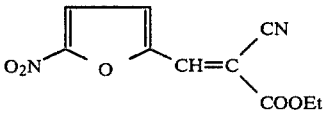 | 0.1 | 350 |
| 14 | 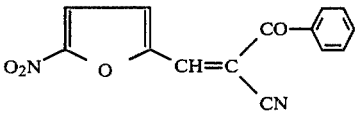 | 0.1 | 380 |
| 15 | 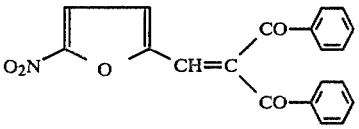 | 0.1 | 410 |
| 16 | 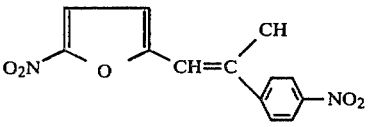 | 0.1 | 97 |
| 17 | 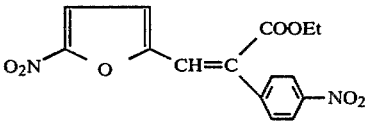 | 0.1 | 90 |

EXAMPLES 18 TO 24

Additional examples were prepared as indicated in Table 2, and all operations of the photosensitivity examination procedure were performed under the same conditions as in Examples 1 to 17, except that a minus 200 V, instead of a plus 200 V, electric field was applied to each of photoconductive materials prepared for corona discharging.

The results obtained are shown in Table 2.

TABLE 2

| Example | 5-Nitrofurfural Derivative | NFD/PVCz (molar ratio) | Half Decay Exposure (lux.sec) |
|---|---|---|---|
| 18 | 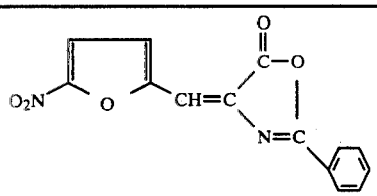 | 0.1 | 117 |
| 19 | 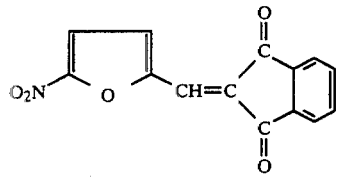 | 0.1 | 178 |
| 20 | 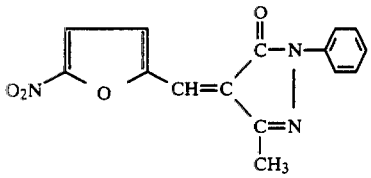 | 0.1 | 530 |
| 21 | 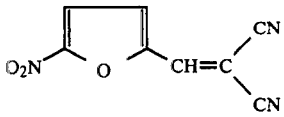 | 0.1 | 230 |
| 22 | 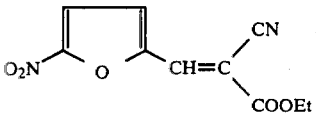 | 0.1 | 250 |
| 23 | 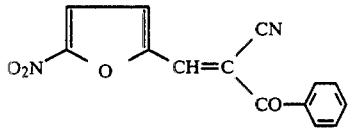 | 0.1 | 98 |
| 24 | 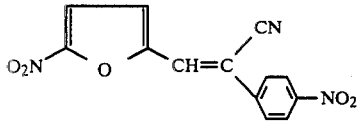 | 0.1 | 97 |

EXAMPLE 25

Polyvinylcarbazole and 4-(5'-nitro-2'-furfurylidene)-2-phenyl-5-oxazolone were dissolved in amounts of 0.2 g and 0.1 g, respectively, in a mixed solvent consisting of 100 g of methylene chloride and 50 g of the insulating solvent of Isoper H (which is the trade name of an insulating solvent containing saturated hydrocarbons comprising mainly decane, dodecane, octane, paraffin and isoctane, produced by Esso Oil Co., Ltd. b.p. 174° C. to 189° C.). Thereafter, the methylene chloride was evaporated at 50° C. to 70° C. so as to be removed from the solution. Thus, particles were obtained in such a state that they were dispersed in the Isoper H. These particles contained therein both polyvinylcarbazole and 4-(5'-nitro-2'-furfurylidene)-2-phenyl-5-oxazolone in a highly compatible condition. Using the photoelectrophoretic imaging method described in Example 1 of the Japanese Patent Publication 21781/'68. The dispersion thus obtained was supplied to a portion between a polyethylene terephthalate support having a polyvinyl alcohol layer thereon and a voltage impressing roller having a vapor deposition layer of $In_2O_3$ thereon, while impressing voltage by the roller. During a rotation of the roller under an impression of voltage, the dispersion of such particles was irradiated with a tungsten lamp for one second under such conditions that the illuminance at the surface of the dispersion became 2 lux while a negative electric potential of 1500 V was applied across the dispersion. An image was thereby formed.

While the invention has been described in detail and with reference to specific embodiments thereof, it will be apparent to one skilled in the art that various changes and modifications can be made therein without departing from the spirit and scope thereof.

What is claimed is:

1. A photoconductive composition containing an organic photoconductive substance and a 5-nitrofurfural derivative represented by formula (1) in a photosensitizing amount (1)

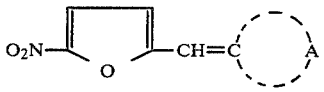

wherein A represents atoms which form, together with the carbon atom, a moiety selected from the group consisting of one of formulae (2) to (10)

(2)

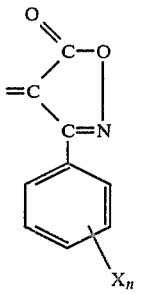

(3)

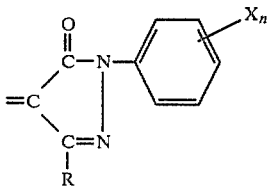

(4)

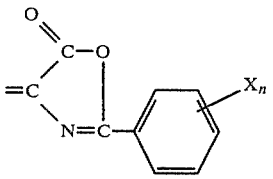

(5)

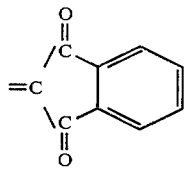

(6)

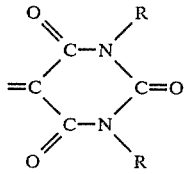

(7)

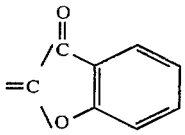

-continued (8)

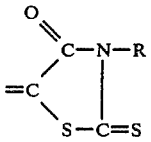

(9)

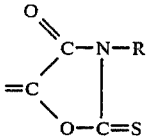

and (10)

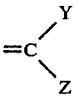

wherein R represents a moiety selected from the group consisting of a straight and a branched chain alkyl group containing from 1 to 12 carbon atoms, X represents a group having a Hammett $\sigma$ value of at least 0.2, n is 0, 1 or 2, and Y and Z each represents a moiety selected from the group consisting of a cyano group, —COOR,

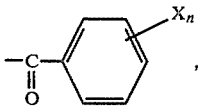

, and

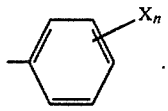

.

2. A photoconductive composition as in claim 1 wherein said photoconductive substance is a photoconductive polymer, and the molar ratio of said 5-nitrofurfural derivative to the $\pi$-electron system containing constitutional repeating units contained in said photoconductive polymer is from 0.02/1 to 1.5/1.

3. A photoconductive composition as in claim 2 wherein the molar ratio is from 0.05/1 to 1.2/1.

4. An electrophotographic photoreceptive material comprising a support including a conductive surface, and a layer formed thereon comprising a photoconductive composition containing an organic photoconductive substance and a 5-nitrofurfural derivative represented by formula (1) in a photosensitizing amount (1)

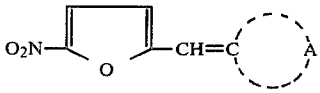

wherein A represents atoms which form, together with the carbon atom, one moiety selected from the group consisting of general formulae (2) to (10) illustrated below;

(2)

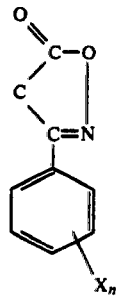

(3)

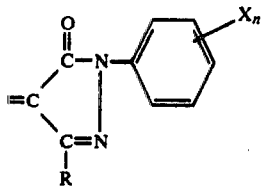

(4)

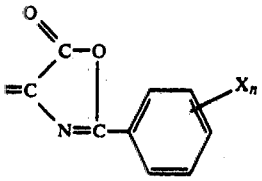

(5)

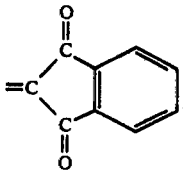

(6)

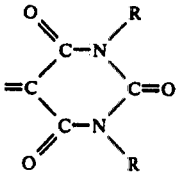

-continued (7)

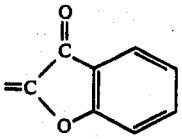

(8)

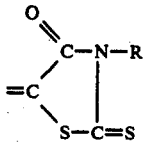

(9)

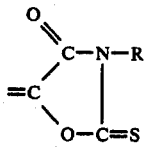

and (10)

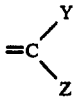

wherein R represents a moiety selected from the group consisting of a straight and a branched chain alkyl group containing from 1 to 12 carbon atoms, X represents a group having a Hammett $\sigma$ value of at least 0.2, n is 0, 1 or 2, and Y and Z each represents a moiety selected from the group consisting of a cyano group, —COOR,

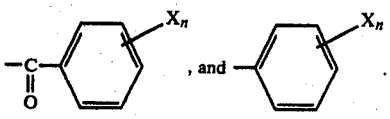

5. An electrophotographic photoreceptive material as in claim 3 wherein said photoconductive substance is a photoconductive polymer, and the molar ratio of said 5-nitrofurfural derivative to the $\pi$-electron system-containing constitutional repeating units contained in said photoconductive polymer is from 0.02/1 to 1.5/1.

6. An electrophotographic photoreceptive material as in claim 4 wherein the molar ratio is from 0.05/1 to 1.2/1.

* * * * *